US006332823B1

(12) United States Patent
Rouse, Jr.

(10) Patent No.: US 6,332,823 B1
(45) Date of Patent: Dec. 25, 2001

(54) BALLOON DISPLAYS

(76) Inventor: Graham M Rouse, Jr., 2442 Wheat St., Columbia, SC (US) 29205

( * ) Notice: Subject to any disclaimer, the term of this patent is extended or adjusted under 35 U.S.C. 154(b) by 0 days.

(21) Appl. No.: 09/066,119

(22) Filed: Apr. 24, 1998

Related U.S. Application Data

(63) Continuation of application No. PCT/US96/17560, filed on Oct. 30, 1996.
(60) Provisional application No. 60/008,096, filed on Oct. 30, 1995.

(51) Int. Cl.[7] ..... A63H 3/06
(52) U.S. Cl. ..... 446/220; 446/221
(58) Field of Search ..... 446/220–226; 156/145, 61; 206/522; 40/212, 214; 428/11–13, 24–26

(56) References Cited

U.S. PATENT DOCUMENTS

| | | | |
|---|---|---|---|
| 2,187,493 | 1/1940 | Gordon . | |
| 2,470,990 | 5/1949 | Kennedy . | |
| 3,358,398 | 12/1967 | Chalfin . | |
| 3,676,276 | 7/1972 | Hirsen et al. . | |
| 4,015,111 | 3/1977 | Spector . | |
| 4,179,832 | 12/1979 | Lemelson . | |
| 4,586,456 | 5/1986 | Forward . | |
| 4,693,695 | 9/1987 | Cheng . | |
| 4,892,500 | 1/1990 | Lau . | |
| 5,023,118 | 6/1991 | Cheng . | |
| 5,117,344 | 5/1992 | Perez . | |
| 5,183,432 * | 2/1993 | Noguchi | 446/220 |
| 5,215,492 | 6/1993 | Kubiatowicz . | |
| 5,254,026 | 10/1993 | Kaiser . | |
| 5,282,768 | 2/1994 | Akman . | |
| 5,533,285 * | 7/1996 | Skistimas et al. | 40/584 |
| 5,675,922 * | 10/1997 | Skistimas | 40/584 |
| 5,769,685 * | 6/1998 | Nakamura et al. | 446/221 |

* cited by examiner

*Primary Examiner*—Sam Rimell

(57) ABSTRACT

A structural and/or decorative display is made by connecting inflatable balloon chambers into a network. The network of inflatable chambers may be generated as a balloon system comprised of at least two essentially identical balloonlets each of which has at least two openings and is in fluid communication with at least one other identical balloonlet. The set of inflatable chambers may be framed into a network by a matrix of apertures expanded from a sheet of material with a pattern of overlapping cuts. The network of inflatable chambers may be comprised of a balloon system of balloonlets framed by an overlapping cut expandable matrix.

10 Claims, 14 Drawing Sheets

Fig 19A
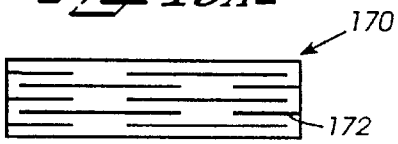
Fig 19C
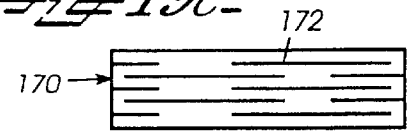
Fig 19B
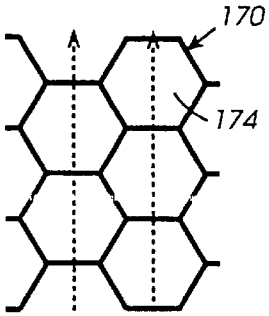
Fig 19D
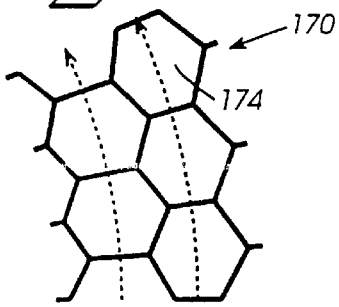
Fig 19E
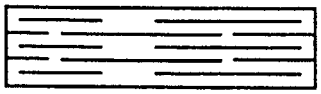
Fig 19F
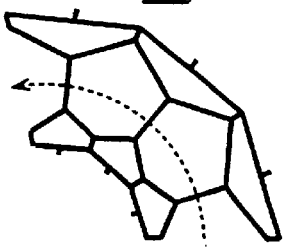
Fig 19G
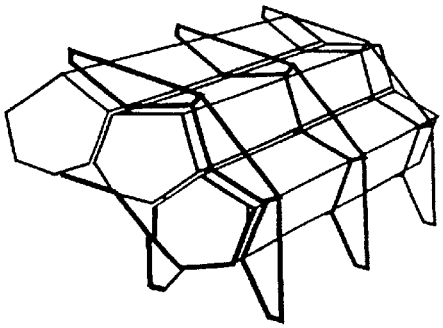
Fig 24A
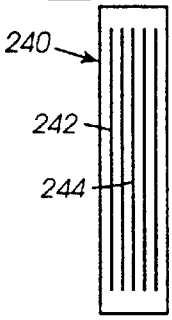
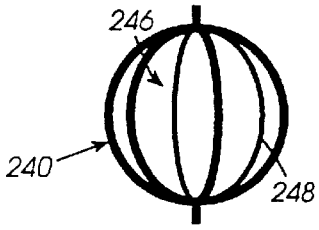
Fig 24B
Fig 25A
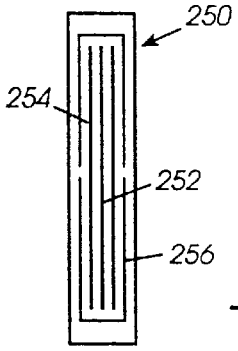
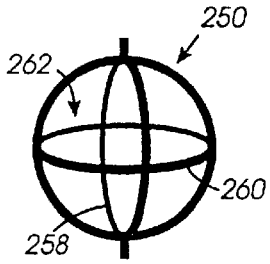
Fig 25B

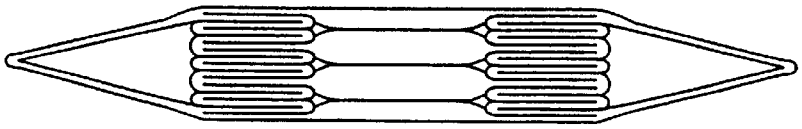
Fig 27A
Fig 27B
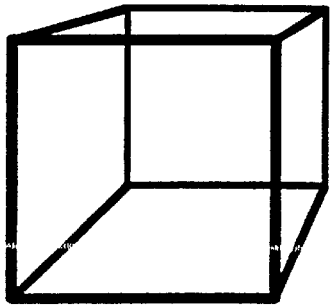
Fig 26B
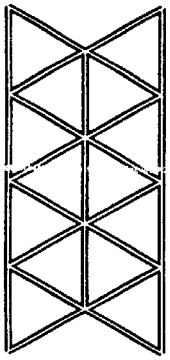
Fig 26A
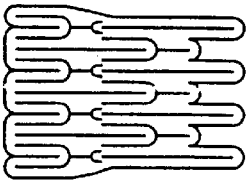
Fig 36B
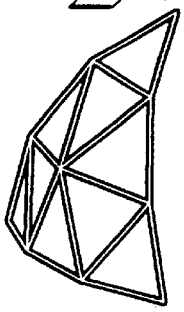
Fig 36C
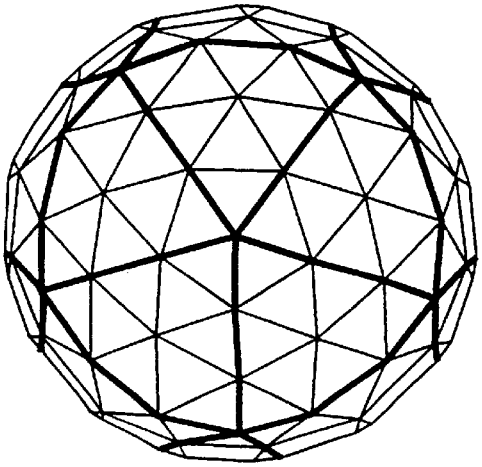
Fig 36A
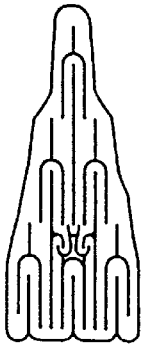
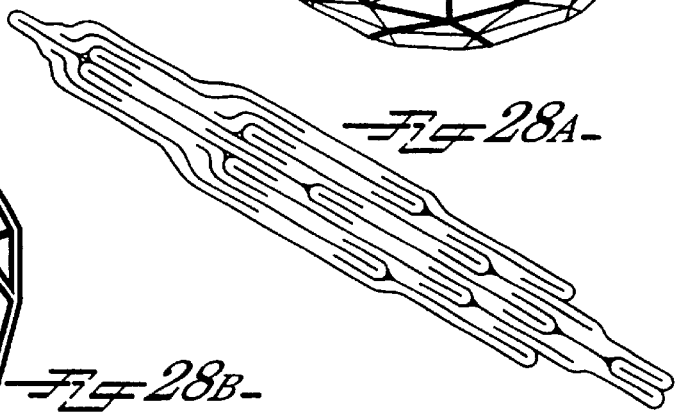
Fig 28A
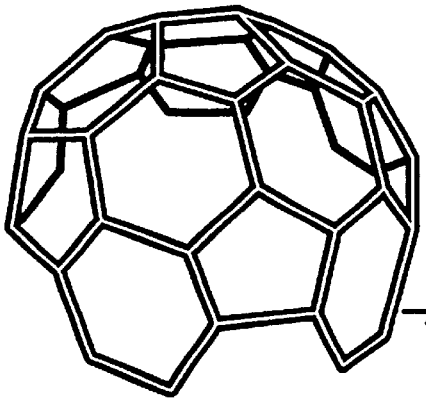
Fig 28B

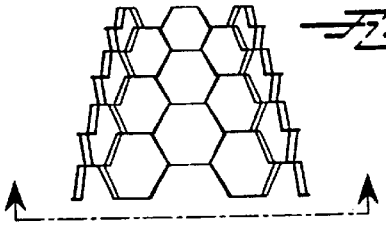
Fig 37A-
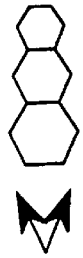
Fig 37B-
Fig 37D-
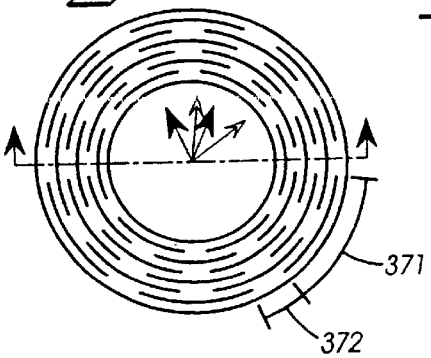
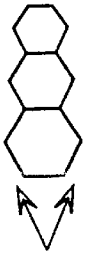
Fig 37C-
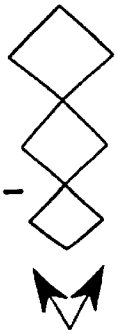
Fig 38A-
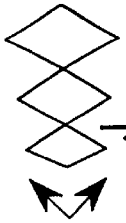
Fig 39A-
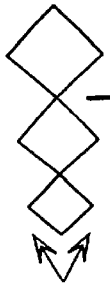
Fig 38B-
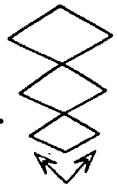
Fig 39B-
Fig 38C-
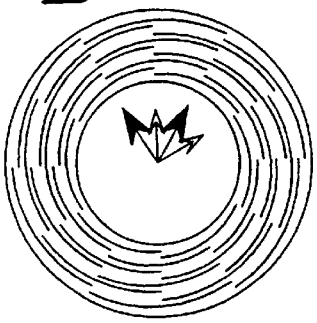
Fig 39C-
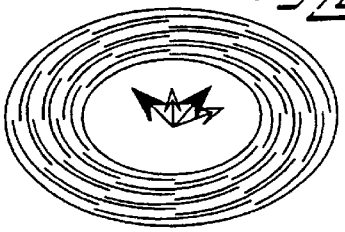

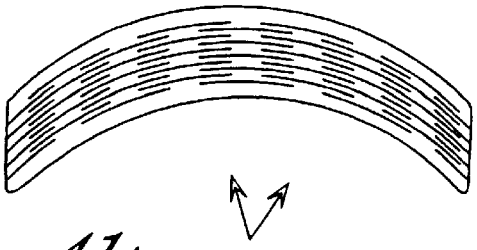
Fig 41A
Fig 40A
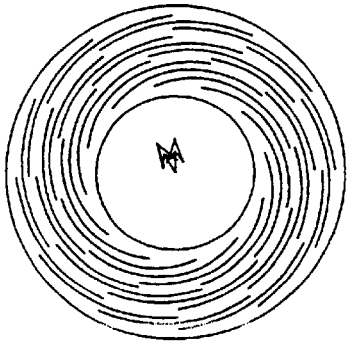
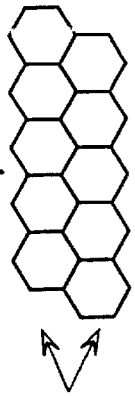
Fig 41B
Fig 40B
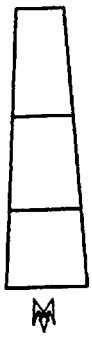
Fig 42A
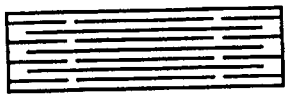
Fig 42C
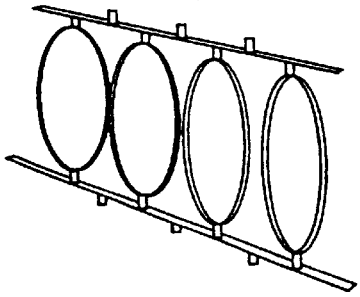
Fig 42B
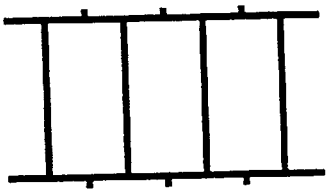

BALLOON DISPLAYS

This is a condition of PCT. U.S. 96/17560 filed Oct. 30, 1996 and claims the benefit of provisional application No. 60/008,096, filed Oct. 30, 1995 .

BACKGROUND OF THE INVENTION

1. Field of the Invention

The present invention is related generally to balloons for use as decoration and decorative architecture. More specifically, the present invention is related to systems for making and supporting balloon structures and displays.

2. Discussion of Background

Balloons have been used as decorations for decades, but they have enjoyed increased usage in the recent past. There are two type of balloons commonly used for decor plus a variety of patented, specialty balloons.

Balloons have traditionally been made of natural latex. Molds are dipped into a vat of liquid latex. Some of the latex adheres to the mold. The mold is removed and the adhered latex dries into a highly elastic membrane. The membrane is removed from the mold for use. The balloon thus created is usually a bulbous form with a single, narrow, tubular stem, and opening for inflation. Once inflated, latex balloons are most commonly sealed by tying a knot in the inflation stem of the balloon. Less common are the use of mechanical fasteners and internally installed, self-sealing valves to seal latex balloons.

There are a large variety of techniques and systems used in the trade to connect latex balloons directly to each other to some common material or object to serve structural and decorative functions. There are, however, relatively few systems especially designed and manufactured for these purposes.

Adhesives are commonly applied to at least one of the surfaces to be connected and the surfaces pressed together and held until the adhesive has set sufficiently to keep the surfaces in contact without special assistance. The adhesives come in a variety of forms including sprays, liquids, temperature based adhesives, and tapes.

There are several mechanical methods for connecting balloons. These include twisting, tying, pinching, and squeezing balloons directly to each other and/or to some structures in common connection with other balloons.

Balloons have long been tied to each other at the neck (the inflation stem) of the balloon. The long, slender balloons (often called "pencil balloons" or "entertainer balloons") are often pinched and twisted at various points along their length. Those points of twisting are themselves twisted together with other such points on the same or other balloons. Balloons have long been tied with and tied to such things such as string, ribbon, monofiliment (plastic or nylon fishing line), wire, and cable ties.

Balloons are often attached to each other or to common structures by actually piercing the skin of the balloon in the section of the balloon stem which is not being used to seal the air chamber. This is often done with paper clips or other sections of wire which are then hooked, twisted or tied to each other or to more substantial structures.

Lighter weight metal rods and tubes, as well as plastic rods and tubes are frequently framing materials of choice as they come in forms stiff enough to keep balloons in planned arrangements and are still flexible enough to be formed by hand or with simple tools. When large numbers of balloons are to be contained, frequently the control is supplied by using bags or nets.

There are an enormous variety of combinations of specific techniques for using adhesives and similar complexities available in mechanical techniques as well. When the two approaches are combined the possibilities multiply again.

For example, adhesives can be used to stick balloons to each other to form a sheet of balloons. The sheet might then be bent into a curved surface and held in that shape by mechanical connections. Such a sheet might form a decorative wall, a canopy or a tunnel.

Helium filled balloons might be connected mechanically to a light weight line so that they float into an arch. The balloons might then be stuck to each other with adhesives to assure that the balloons do not spin around and hide important graphics on their surfaces.

The use of grids has followed two basic paradigms. The first paradigm employs holes cut in sheets of material. Selected holes hold balloons by squeezing the balloon into the hole or by passing the stem or a tie connected to the balloon through the hole and attaching it to the material. While these cut outs are generally accomplished with an efficient die cutting process, this paradigm generates considerable waste from the cut outs made in the processing. The framing elements (around the apertures) and the apertures remain essentially the same size when put to use as they are at the time of manufacture. The finished display is limited to the original size of the sheet plus overhang from the connected balloons.

The second paradigm assembles elements utilizing basically rigid joints. Such an (approach usually has less wasted material than in the first paradigm, but has the added expense of making those joints. The framing elements (around the apertures) and the apertures remain essentially the same size when put to use as they are at the time of manufacture. The finished display is limited to the size of the manufactured framework plus overhang from the connected balloons.

The use of these common techniques along with manufactured frameworks has developed largely in the last decade. There have been only a few of these frameworks designed and manufactured specifically for use with balloons.

For example, in 1985 Marvin Hardy reports using pegboard as a framework to hold balloons with the necks of balloons pulled through the regular pattern of small holes in these sheets of composite wood. Over the next years he used slotted plastic disks to pinch the necks of the balloons to keep them from pulling back through the holes. Spoony Morrill, according to August 1987 issue of *Balloons Today* magazine, introduced the use of existing, flexible, net grids as framework for balloon graphics. Balloons were attached in a single layer with paper clips or by tying them directly to the nets.

Graham Rouse, in March 1988 at a convention of the National Association of Balloon Artists, introduced Rouse Balloon Art Designer Panels™ specifically designed and produced for balloon decorating. These corrugated board panels form a regular, semirigid, and modular system having an array of apertures to connect and hold balloons in a network for walls and other graphic and sculptural displays. Balloons were generally attached by pulling the neck of a balloon through one hole, stretching the neck to a slit radiating from an adjacent hole, and then pinching the neck in the slit.

Later that year, in July, the Rouse Balloon Art Designer Panels™ were exhibited at the Flowers, Inc. Balloons open house as a system for squeezing balloons into apertures smaller than the natural diameter of the inflated balloons in order to hold the balloons in place for graphic and sculptural displays.

In 1990, Marvin Hardy began to use his Jiffy Strips™, which are ¾" wide strips of translucent plastic having small holes and slits at 1" intervals to hold balloons tightly against the strips by stretching the neck through a hole and then pinching the balloon neck into an adjacent slit. Jiffy Strips™ may be placed at right angles to form grids or grouped in roughly parallel strips to cover large and irregular surfaces.

About the same time, Kevin LaCount used manufactured wooden lattices to hold balloons by squeezing the balloons into the openings in the lattice. In commercial decoration applications, David Gully used manufactured wire grids into which he squeezed balloons to create decorative patterns.

In 1993, Marvin Hardy introduced his MagiGrid™. This looks much like a rectangular grid wire fence only made of heavier metal rods and straps. The size of the openings may be changed from one use to the next. Balloons are squeezed sideways (i.e., held by pressure against top, bottom, and two sides) into the grid. This configuration hides the necks as well as most of the frame and promotes viewing from front or back.

More recently, in 1994, James Skistimas introduced his Skistimas Design System™. This system combines the modular concept of Rouse Panels™ in a 24" by 48" size with a 6 inch square grid wire frame like that used by David Gully. This system adds a second layer of metal frame to each panel for increased strength and stability. It holds foil as well as latex balloons with the same look as the Magi-Grid™.

The current variety of frameworks are useful. Additional improvements to make them lighter, more flexible, more compact in storage and transporting and to make them more versatile would add considerably to their value. None of the current systems is particularly good for canopies or doubly curved surfaces. Furthermore, none are manufactured to produce many popular solid shapes, although there are outline shapes for hearts and balloon nets in the shapes of hearts and stars.

The second type of balloon commonly used for decor is made by heat sealing two layers of thin, light weight, air-tight film together along lines which define the outer edges of the balloon shape. The balloon thus created is usually a bulbous form with a single, narrow, tubular stem, and opening for inflation. Once inflated, film balloons are most commonly closed by heat sealing the open stem. Self-sealing valves in the stems of the film balloons is rising in importance as the sealing method of choice. Tying knots in the stem of the film balloons is becoming less common and mechanical fasteners are also less common with film balloons.

The variety of techniques and systems used in the trade to connect film balloons parallels that of latex balloons. One exception, however, is the use of paper clips or other wire hooks poked through the uninflated stem of the latex balloon, because films commonly used for balloons, although quite strong, tear easily once penetrated. A second exception is pinching and twisting a film balloon across an inflated chamber, because the relatively inelastic nature of films makes such a procedure impractical.

Under current standard manufacturing methods for film balloons, a single die impression may produce multiple identical balloons either by repeated application or by one application of a complex die, however, the balloons thus created are not in fluid communication. Also under current methods, a single die impression may produce multiple chambers in fluid communication, but the chambers are not identical and balloons created are a series of single balloon of complex shape. Finally, multiple dies may be used on a common sheet of film, but the balloons thus created are not in fluid communication with each other.

Under current methods each die impression produces independent balloons which look and function like independent balloons. Each balloon must be inflated and sealed independently and individually joined with others into groups or placed as an independent decorative element. Film balloons are more expensive than latex, but they are stronger, last longer and can be reused. In order to save them for reuse, however, each balloon manufactured under current methods must be unsealed, deflated and packed for storage independently.

Balloons with special features or contours are known and have been the subject of U.S. Patents. For example, Akman (U.S. Pat. No. 5,282,768) teaches a balloon with a tube passing there though. The tube pierces the wall of the balloon and is sealed to the wall with constriction rings. Hirshen, et al. (U.S. Pat. No. 3,676,276) describe a plurality of inflatable, individual cells that are interconnected. Each cell is independently inflated.

Devices having a plurality of interconnected balloons are also well known. Lau (U.S. Pat. No. 4,892,500) and Gordon (U.S. Pat. No. 2,187,493) both show balloon networks. Lau provides balloons with multiple spouts thus, the balloons can be connected to other balloons or a pole using adapter plugs. Gordon attaches balls to the outer ends of a plurality of arms that extend from a central hub.

Lemelson (U.S. Pat. No. 4,179,832) and Chalfin (U.S. Pat. No. 3,358,398) teach inflatable display devices. In Lemelson's device, a plurality of inflatable, upwardly-extending portions are welded to an inflatable ring. Strings of lamps extend along the inside or outside walls of the display. Chalfin places inflatable letters in a channel so that the letters are held within the channel. Alternatively, the letters are integrally formed with an inflatable base.

Kennedy (U.S. Pat. No. 2,470,990) describes a method for making permanently-sealed inflated toys. Plastic sheet material is printed or silk screened to produce a plurality of outlines extending outwards from a central channel, then heat-sealed to another sheet using a die to form shapes connected to a single manifold. The shapes are inflated then heat-sealed at there connection to the manifold and cut from the manifold.

There remains a need for a way to produce a display of many film balloons and to be able to inflate, install, and later deflate and remove them quickly and easily. Such advances could make professional decorating with film balloons more cost competitive with decorations ordinarily done with latex balloons and with decorations done in other media. Such advances could make amateur decorations easier and quicker so as to appeal at a less skilled mass market.

SUMMARY OF THE INVENTION

According to its preferred aspects and briefly stated, the present invention is a balloon display system. The system includes balloons and means for supporting the balloons in an arrangement that is either pleasing or informative or both. The balloons may be common, individual balloons, but are preferably "film balloon systems." The supporting means is a matrix either made by expanding a sheet of material into which an array of slits has been cut or by using a multidimensional film balloon system. All three of these terms will be defined herein, however, a balloon system is a single balloon that appears to be a plurality of balloons, called "balloonlets" herein, but which are inflated and deflated all at one time, and which, when inflated, are configured with respect to each other to effect a balloon display. The expandable matrix is a sheet of single or multiple layers that is strong, flexible, somewhat resilient material into which a pattern of overlapping cuts has been made so that, when expanded, will form a patterns of holes for holding balloons or balloonlets. The multidimensional balloon systems is essentially a single, three dimensional balloon composed of balloonlets, openings, and passages that add strength and function to the system. The system can thus serve not only as a balloon display, possibly free-standing, or as a grid for supporting balloons itself. The result of the combination of balloon systems and matrixes made according to the present invention is a new tool for those who wish to create unique and dynamic balloon structures and displays quickly, easily and inexpensively.

The balloon system is constructed primarily by the repeated application of the same die, a die that is formed to interconnect the shape so formed so that each balloonlet created by the die is automatically in fluid communication with the previous one formed. Additionally, certain features are incorporated into the interconnecting conduits so that the balloonlets maintain their alignment when inflated. Also, variations in the primary process are taught herein to allow variations in the chain of balloonlets. Because the balloon system is actually all one balloon, although it may appear to be dozens, perhaps thousands, of balloons, it has the advantage of being more easily inflated than individual balloons that would otherwise be needed to create the same display. To minimize the risk of puncture in a balloon system that is actually one large balloon, high quality, more puncture-resistant balloon films are preferred to latex rubber.

The grid structure that is used with the present balloon display is created under a third paradigm, as opposed to the first two described in the Background of the Invention. This paradigm begins with a structure similar to the formation of expanded metal grids for walkways, but by using certain techniques outlined herein, such as hooked and forked cuts and by shaping the material in certain ways, the result is a high degree of design flexibility. The present invention goes beyond standard overlapping cut expandable grids to produce a variety of expandable matrixes in flat shapes and patterns and in three dimensional forms not feasible under the preexisting state of the art. These cuts are generally made with an efficient die cut process as in the first paradigm, and yet, the thin character of the cuts minimizes waste material. Furthermore, none of the more costly assembling of elements required in the second paradigm is necessary. Because of the expandability of products manufactured under the third paradigm, the finished display may easily be five or more times the size of a manufactured framework. This efficiency of production and compactness along with related lighter weight are important advantages for uniting and connecting balloons into balloon displays.

Also, the cut is preferably made with rounded ends to avoid tearing the material. Many materials useful for balloon displays because they are light-weight, flexible, somewhat resilient and inexpensive are quite strong under tension, but rip easily once a tear has begun. Simple slits have the nature of a tear and, in such material, could render the sheets useless for the normal stresses of an overlapping cut expandable framework. By making careful cuts with smoothly rounded ends, the cut could take on the nature of an outer edge of the sheet rather than a tear. Even materials which resist ripping after a tear will be strengthened by the change to carefully made rounded ends to the cuts.

The simplest form of balloon system is a row of balloonlets. However, by the use more complex dies, as would be best effected with a computer controlled laser sealing process, by use of more than two layers, and by use of a predetermined pattern of adhesive treatment, extraordinary structures can be created in three dimensions. These structures are single balloons, and when inflated, form passages, balloonlets, and openings for other balloons, balloon systems, and possibly other objects. The advantage of such a multidimensional balloon system is that complex three dimensional balloon shapes can be made of a single high-quality balloon for repeated use.

Many other features and advantages will be apparent to those of ordinary skill in the art of making and using balloons from a careful reading of the Detailed Description of Preferred Embodiments of the present invention, accompanied by the associated drawings.

BRIEF DESCRIPTION OF THE DRAWINGS

In the drawings:

FIGS. 9A–G illustrate top and side views of a standard double column matrix (FIGS. (9A and 19B, respectively) and of an equivalent double column matrix (FIGS. 19C and 19D, respectively) with spaces of different length and different alignment used to make a curved expanded matrix and of an equivalent single column matrix (FIGS. 19E and 19F respectively) with specialized side slits which expand into reinforcing bands for the matrix and a perspective view (FIG. 19G) of three, parallel, expanded matrices of the kind in FIG. 19F with objects through their apertures;

FIGS. 24A and 24B illustrate unexpanded top and expanded side views, respectively, of a matrix with longitude grouped slits;

FIGS. 25A and 25B illustrate unexpanded top and expanded side views, respectively,of a matrix with combined longitude and latitude grouped slits;

FIGS. 26A and 26B illustrate unexpanded top and expanded side views, respectively, of a matrix in a pattern comprising stacks of alternating triangles;

FIGS. 27A and 27B illustrate unexpanded top and expanded perspective views, respectively, of a matrix pattern;

FIGS. 28A and 28B illustrate unexpanded top and expanded perspective views, respectively, of a matrix in a half-soccer ball (truncated icosahedron) pattern;

FIGS. 34A and 3B illustrate unexpanded top and expanded side views, respectively of an expanded matrix in an octagon-and-square pattern;

FIGS. 36A–C illustrate unexpanded top, expanded perspective and assembled perspective views, respectively, of a matrix section which assembles into a geodesic sphere;

FIGS. 37A–D illustrate an expanded section view, two expanded angular elevation views and an unexpanded top view respectively of a concentric matrix;

FIGS. 38A–C illustrate two expanded angular elevations and one unexpanded top view, respectively of a concentric matrix with virtual touching of cuts to produce four sided polygon apertures, FIGS. 39A–C illustrate two expanded angular elevations and one unexpanded top view, respectively of a concentric matrix that is not a circle;

FIGS. 40A and 40B illustrate an unexpanded top and expanded angular elevation view of a concentric matrix with overlapping cuts in the same band of cuts;

FIGS. 41A and 41B illustrate an unexpanded top and expanded angular elevation view of a non straight, parallel matrix.

FIGS 42A–C shows a top view, a side view, and a perspective view, respectively, of a "tubular frame" matrix.

DETAILED DESCRIPTION OF PREFERRED EMBODIMENTS

Figure 1:
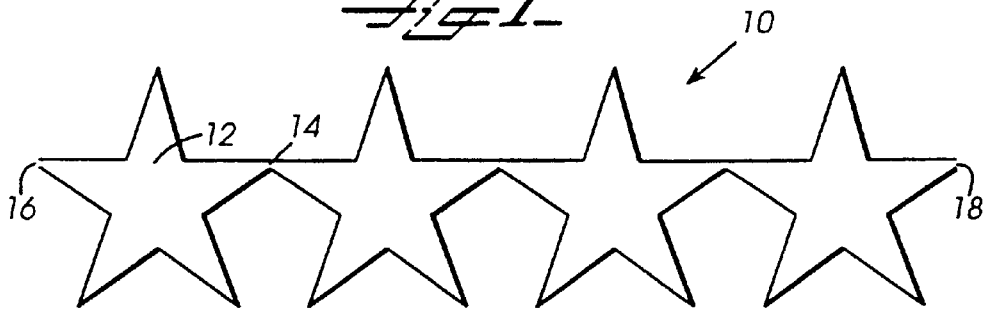
FIG. 1 is a plan view of a balloon system according to a preferred embodiment of the present invention with balloonlets in direct connection.

The present invention involves a combination of two fundamental concepts: the balloon system concept and the overlapping cut, expandable matrix concept. The balloon system is essentially a set of techniques for manufacturing a single balloon in one, two, and three dimensions that has the appearance of multiple balloons or even three dimensional shapes composed of what appear to be multiple balloons. This balloon system will be described generally and then with regard to the figures.

The second fundamental concept is the overlapping cut matrix, which begins with a simple grid similar to the expanded metal walkway that produces the appearance of an hexagonal or diamond matrix, but it is modified for the particular, present use, and then proceeds to the inclusion of one or more special techniques for making cuts that allow the designer significant design flexibility. The grid supports balloons of either the traditional individual balloon type or, preferably, the balloon system type.

A major element of the present invention is a decorative balloon system composed of a plurality of balloonlets. As previously defined, a balloon system is a single balloon that appears to be a sequence of many individual balloons, but is really a sequence of balloonlets connected so as to be in fluid communication with each other. The term "balloonlet" refers to a part of a balloon, but not, by itself, an individual balloon. A balloonlet may have a complex shape, and may itself appear to be a cluster of interconnected balloons, but it is only a part of a much larger balloon. The balloon system can be in the form of a linear, arcuate or circular sequence of balloonlets, or a variety of two and three dimensional solid or shell configurations, and the number of balloonlets comprising the balloon system may be quite large.

There are four basic methods to create balloon systems. In the first method, a single die is designed and applied such that either alone or in conjunction with impressions from other dies, it creates at least two essentially identical balloonlets each of which has an inlet and outlet opening and each of which is in fluid communication either directly or through another balloonlet, with at least one other identical balloonlet created by one or more additional impressions of that same die.

In the second method, a single die is designed such that with a single impression of the die it creates at least two essentially identical balloonlets each of which has an inlet and outlet opening and each identical balloonlet is in fluid communication, either directly or through another balloonlet, with at least one other identical balloonlet.

In the third method a single die is designed and applied such that it fills the function of multiple parallel dies simultaneously applied. Separate zones on the die make impressions of balloonlets which do not necessarily connect with each other, but do connect in fluid communication by repetitions of themselves when the die is subsequently reapplied. This creates multiple, parallel balloon systems using a single die.

In the fourth method, any one or combination of the first three methods is used on multiple (three or more) layers of balloon film to create multiple, identical chambers, where at least one balloonlet is in fluid communication with at least one other identical balloonlet which has both an inlet and outlet to its chambers.

Traditionally, one thinks of a die as cutting or forming hardware approximately the size of the product to be made. When the die is applied, the product is cut or formed from a larger, unshaped material. However, the present invention contemplates that there may be and will be other ways of making a shaped or cut product from uncut, unshaped materials in addition to mechanical stamping or cutting. We intend our use of the term "die" to include those technologies for making impressions, cutting, and sealing film layers together whether they are very much like current mechanical dies or combinations of plotters, lasers, and robotics, or other technologies. Furthermore, a die also includes the software or programming that controls the hardware as an integral part of the total "die" since, the software determines when and where the impression is made.

It is also traditional in the art of balloon display systems to think of heat-sealing as the method of bonding layers of film and to think of heat-cutting as the method of separating the balloon portion of the film from the non-balloon portion of the film. In this patent application we conceive of "sealing" and "cutting" to include mechanical, chemical, heat, and all other forms of bonding and separating appropriate portions of the film.

It is also traditional in the art to think of "the balloon" as being made only from portions of film cut out of the larger sheets of film. In this patent application we conceive of "the balloon" to be the inflatable portion of the film regardless of whether the inflatable portion is the portion cut out of a larger section of film or the portion that remains after a portion is cut out and discarded.

A balloon system made with these methods may be constructed to have as many balloonlets as there is material for making the system. The openings at one end of the system may be sealed and the entire array of balloonlets inflated at once from the remaining open end. The entire array of balloonlets may then be sealed at once at the remaining open end. The entire array of balloonlets may be installed as a group for many forms of decorating. The entire array of balloonlets may be deflated at once by opening only one end of the balloon system. The entire array of balloonlets may then be rolled up and stored.

In the present invention, the balloon system is made by repeated, sequential application of a die to the balloon material. Preferably, the balloon material, whether rubber or plastic or some other suitable inflation-gas-impermeable, resilient material wound onto spools, is removed from the spools and runs under a single die that is repeatedly applied. Each application of the die defines a balloonlet and each balloonlet is connected by the shape of the die and the rate of material movement with the next balloonlet so that all the balloonlets are in fluid communication so that, when the first end of the first balloonlet is sealed, all the balloonlets can be inflated by blowing gas into the second end of the last balloonlet. Alternatively, both ends can be sealed and a valve inserted at some location anywhere in the system.

The use of plastic balloon material with the present method of repeated application of at least one die to produce balloonlets forming a balloon system is another important feature of the present invention. The balloon system depends naturally on the integrity of the balloon material, because a leak in any one balloonlet is a leak in the entire system. Therefore, the use of better balloon material, such as nylon or polyester film, allows significantly greater confidence that a non-leaking balloon system according to the present invention can be made. Moreover, the fact that the present system can be easily deployed and taken down (i.e., deflated) for reuse, would justify the higher cost for premium materials.

The present invention's various features—easily made arrays of balloonlets and clusters of balloonlets—work together to enable those who specialize in balloon decoration sets to create more elaborate, more fanciful balloon decorations and to set them up and take them down faster, more cheaply, and with less skilled help. The present invention's various features will also allow non-specialists and many consumers to decorate in ways that would not previously be practical for them and to do them with consistently good results.

A multilayered balloon network is a combination of at least three layers of gas-tight film with at least one inflatable chamber between two layers of film and at least one additional layer of attached film. These multilayered networks comprise a system of balloonlets in fluid communication, but also have additional layers of attached film with chambers attached. Some of these chambers have openings in or passages through the seals that connect them to other layers. The layers of film are treated with decorative, protective, seal-facilitating or seal-inhibiting coatings on pre designated portions of their surface so that, when the dies are applied, seals are formed between layers where desired, but not where the layers are to remain separate.

The present invention teaches two general methods of making multilayered balloon networks. In the basic, general method, multiple layers of film are first given appropriate combinations of coatings of seal-facilitating, seal-inhibiting, and decorative materials in especially configured, predesignated patterns on the surfaces of the layers. In some cases, patterns of cuts or holes may be made to some of the layers. The layers are then placed on each other in registration on a carrier surface for the die impressions to be made in order to seal and cut the predetermined points lines and areas of film. By virtue of differences in the type and locations of coating treatments and in the differences in the cuts and holes in the layers of film, the process of die sealing and cutting will produce a three-dimensional structure with horizontal and vertical interconnected passages, openings, and chambers defined by sealed boundaries, slits and holes. This three-dimensional structure is one balloon having the desired shape given by the designer.

Figure 2:
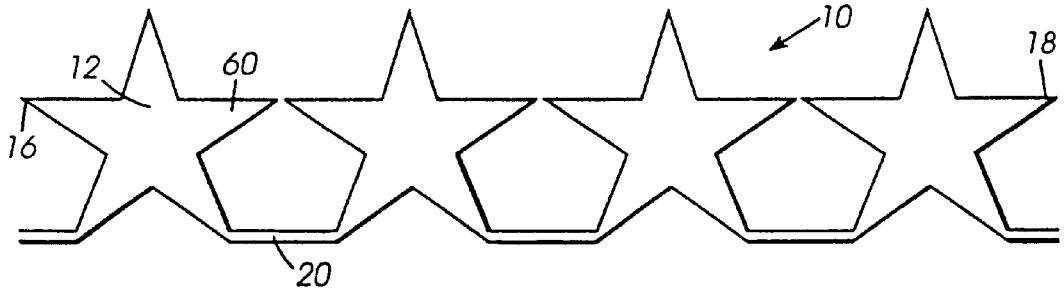
FIG. 2 is a plan view of a balloon system according to an alternate preferred embodiment of the present invention with balloonlets connected through hollow stems.
Figure 3:
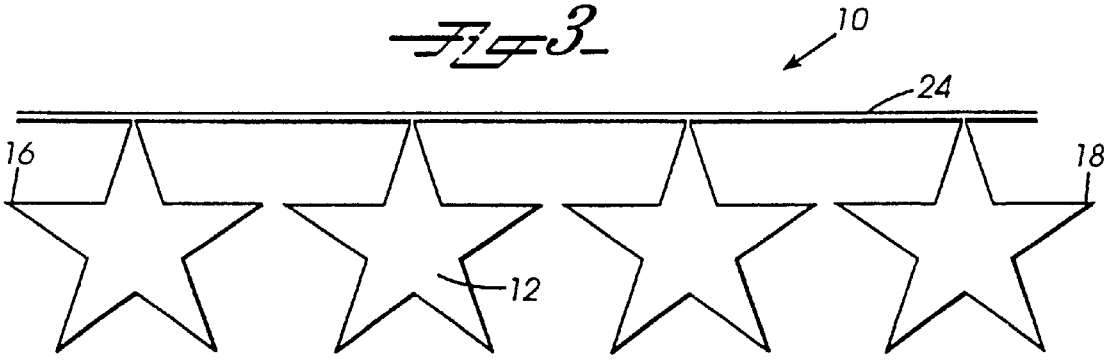
FIG. 3 is a plan view of a balloon system according to an alternative preferred embodiment of the present invention with balloonlets connected through a common manifold.
Figure 4:
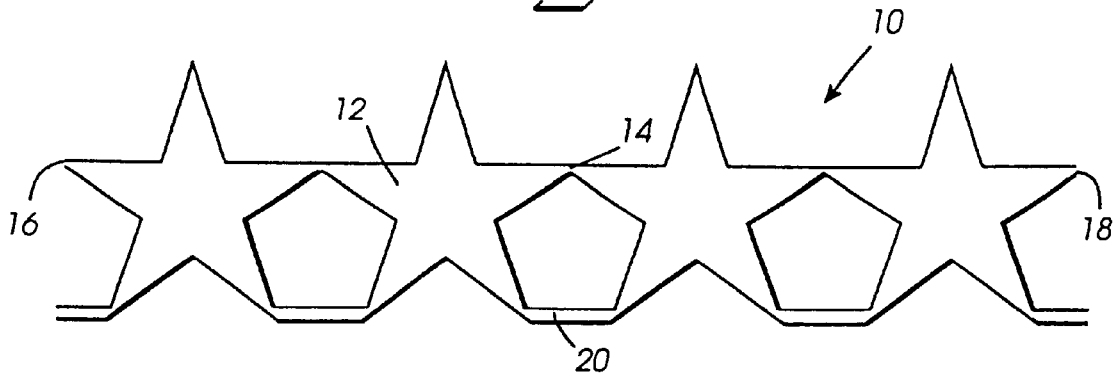
FIG. 4 is a plan view of a balloon system according to an alternative preferred embodiment of the present invention with balloonlets that have multiple connections to adjacent balloonlets.

Referring now to FIG. 1, there is shown a balloon system made according to a preferred embodiment of the present invention and generally indicated by reference numeral 10. Balloon system 10 has a first end 16 and a second end 18. In this embodiment, balloon system 10 is made by a repeated application of a star-shaped die in such a way that star-shaped balloonlets 12 have fluid communication through contacts 14. These contacts 14 are made by a slight overlap of the points on the opposing sides of each balloonlet 12. While five pointed star shapes with two open ended points are illustrated here, any desired shape might be used as long as it allows for fluid communication between balloonlets 12 through contacts 14. For example, in FIG. 2, each star balloonlet 12 of balloon system 10 is connected at its points by a conduit 20. As another example, FIG. 3 shows a second alternative connection for balloonlets 12 of balloon system 10. Each is in fluid connection with a manifold 24. The foregoing fluid connections can be combined, as illustrated in FIG. 4, which uses both contacts 14 and conduits 20 to connect balloonlets 12 of a balloon system 10.

Contact 14, conduit 20, and manifold 24 are each designed to be hollow and to allow air or other balloon-filling gas such as helium to pass freely from one balloonlet 12 to another.

It will be clear that any number of balloonlets 12 may be strung in a row simply by a sufficient number of applications of the balloonlet die. The die, in whatever shape it is configured, must provide for either contact 14, conduit 20 or manifold 24 in its shape to be on the inlet and opposing outlet sides of each balloonlet, and to be oriented so that the outlet of a first balloonlet connects automatically with the inlet of the next Balloon system 10 may be stored in a roll or layers and later cut into a desired number of shorter balloon systems of equal or different lengths. Each system may be sealed at first end 16 and then inflated through and sealed at second end 18 for use. After use, one end or other point in the system, may be cut open and the whole system deflated and stored for repeat use.

Figure 5:
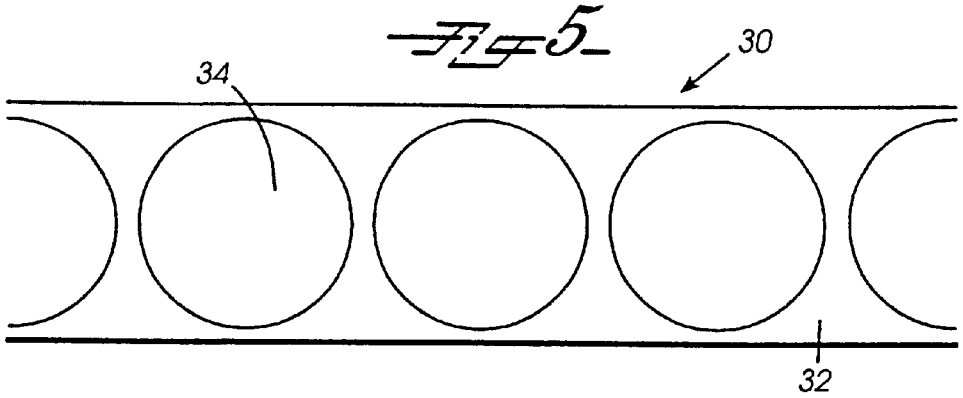
FIG. 5 is a plan view of a balloon system according to an alternative preferred embodiment of the present invention with balloonlets which surround portions of the film which are cut out or left as uninflated panels.

Referring now to FIG. 5, there is shown an alternative preferred embodiment of a balloon system 30 made according to the present invention. In this embodiment, a balloon die in the shape of a banner 32 with circular holes 34 cut out (or simply to be left uninflated) is repeatedly applied to the balloon material. While it is anticipated that the balloonlet shape will most often be a recognized "positive form" such as a star, square, circle, etc., as illustrated in the star-shaped balloonlets 12 of FIGS. 1–4, FIG. 5 illustrates that the balloonlet can also be the surrounding structure which defines a more recognizable "negative form" such as a hole in the shape of a circle, star, square, etc., cut in an inflatable panel.

Figure 6:
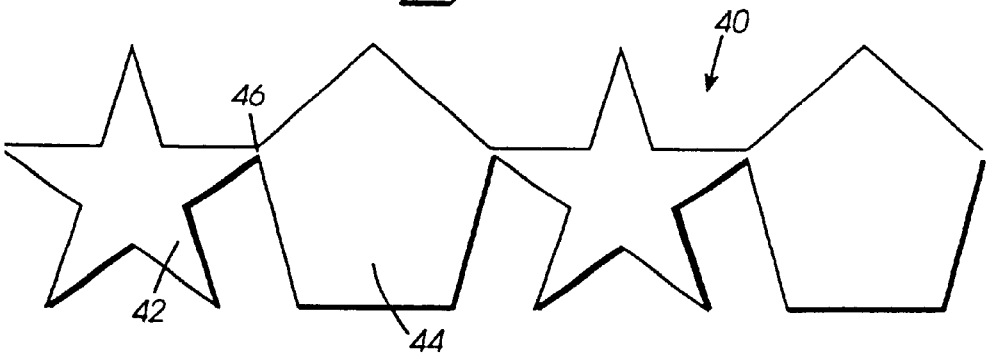
FIG. 6 is a plan view of a balloon system according to an alternative preferred embodiment of the present invention with balloonlets which are made with multiple dies.

Referring now to FIG. 6, there is shown an alternative preferred embodiment of a balloon system 40 according to the present invention. In this embodiment, balloon system 40 is composed of an alternating series of balloonlets 42 and 44. Balloonlet 42 is in the shape of a five-pointed star; balloonlet 44 is in the shape of a pentagon. Each balloonlet 42, 44, is connected by contacts 46 with the balloonlets on either side of it so that all balloonlets 42, 44, of balloon system 40 are in fluid communication and constitute, in fact, one balloon.

It will be clear that a single die having both a five-pointed star and an adjacent, connected pentagon could have been made and repeatedly applied to make the same balloon system 40. It will also be clear that any sequence, repeated sequence or random sequence, of dies forming balloonlets of different shapes could be used to make a single balloon system provided that all dies form shapes that have overlapping inlets and outlets to allow contacts 14, as illustrated in FIG. 1; conduits 20, as illustrated in FIG. 2; manifolds 24, as illustrated in FIG. 3; or combinations of these, as illustrated in FIG. 4.

Figure 7:
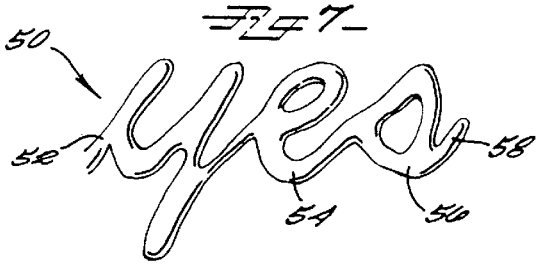
FIG. 7 is a plan view of a balloon system according to an alternative preferred embodiment of the present invention with balloonlets which are made with multiple dies including terminal dies which may be used only at specified ends of the balloon system.

Referring now to FIG. 7, there is shown an alternative preferred embodiment of a balloon system 50 according to the present invention. This embodiment illustrates how a balloon system can be made by the application of different dies in such a way as to create balloonlets that spell the word "Yes". Each letter, "y", "e", "s", plus an endcap, is a separate balloonlet 52, 54, 56, and 58. All are in fluid communication provided that the dies are configured so that the balloonlets are in fluid communication when cut in the preselected series.

Die impressions can be made to be "universal" in that they may be arranged in any order desired and repeated as many times as desired within the balloon system illustrated and can still produce the fluid communication among the balloonlets that will result in a single balloon system. End cap 58 of balloon system 50 also illustrates functional components of a balloon system. A die does not have to make only ornate balloonlets, but can alternatively impress the balloon material with shapes for functional considerations, such as stems, end caps, conduits for creating spaces between balloonlets, tie straps, and so on. But some portions of the die impression can incorporate functional features along with ornamental features.

Figure 9:
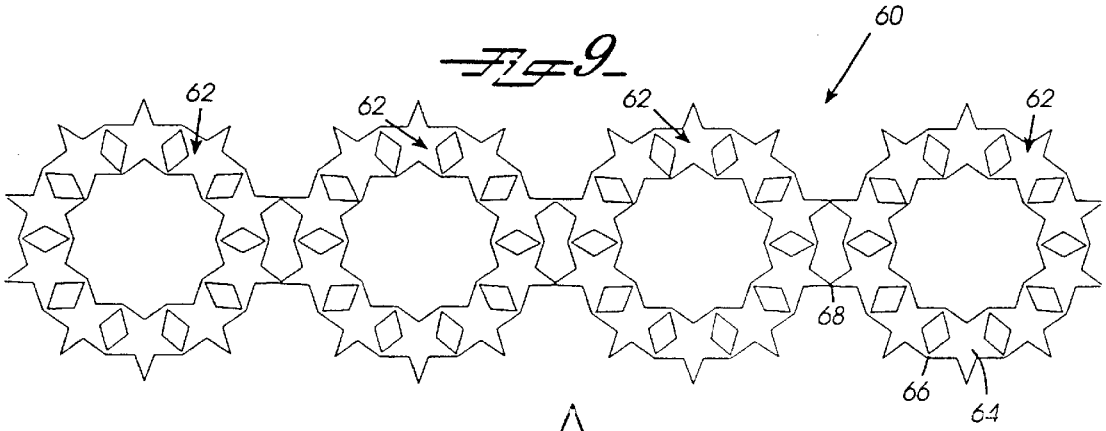
FIG. 9 is a plan view of a balloon system according to an alternative preferred embodiment of the present invention with the balloon system composed of a series of balloonlet clusters.
Figure 8:
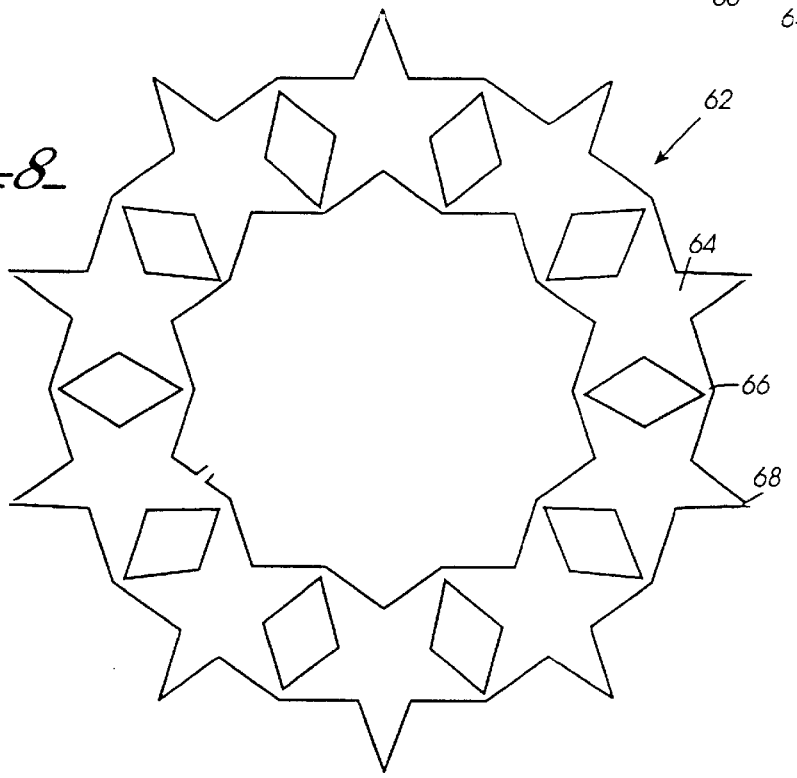
FIG. 8 is a plan view of a balloon system according to an alternative preferred embodiment of the present invention with a cluster of balloonlets produced with a single

Referring now to FIGS. 8 and 9, there is shown yet another balloon system 60, this one having a cluster of balloons for each balloonlet 62. Each balloonlet 62 of balloon system 60 is a ring of five-pointed stars 64. All stars 64 in each balloonlet 62 and all balloonlets 62 are in fluid communication with each other; filling any one with air or helium will begin to fill them all. Although intricate and appearing to be possibly hundreds of balloons depending on the length of balloon system, balloon system 60 is one continuous balloon.

Figure 10:
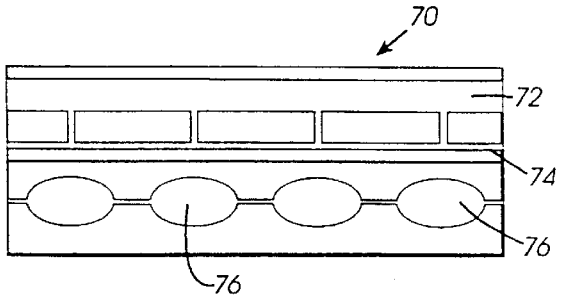
FIG. 10 is a plan view of multiple balloon systems according to an alternative preferred embodiment of the present invention with a single die used to simultaneously produce the multiple balloon systems.

Each star 64 is connected to two adjacent stars 64 at the tips of two of its adjacent points 66 both for fluid communication and orientation. Not only will that connection allow the balloon-filing gas to circulate from one to the next, it also orients one star 64 to the next one so that the ring is formed. In each balloonlet 62, two stars on each side have additional points 68 that are in fluid communication with the next balloonlet 62. FIG. 10 illustrates a section of balloon material 70 where a die has been repeatedly applied to form three separate balloon systems: a straight tubular balloon system 72, a manifold tubular system 74, and a balloon string system 76. Each balloonlet of each system 72, 74, 76 is in fluid communication with the next balloonlet, but none of the systems is in fluid communication with the other. This figure illustrates that a die can make more than one balloon system in parallel.

Also, as indicated above in the description of FIG. 5, material that is not part of the gas-filled balloon need not necessarily be cut away, but could be functional or could carry a design or printing for decorative purposes.

Figure 11:
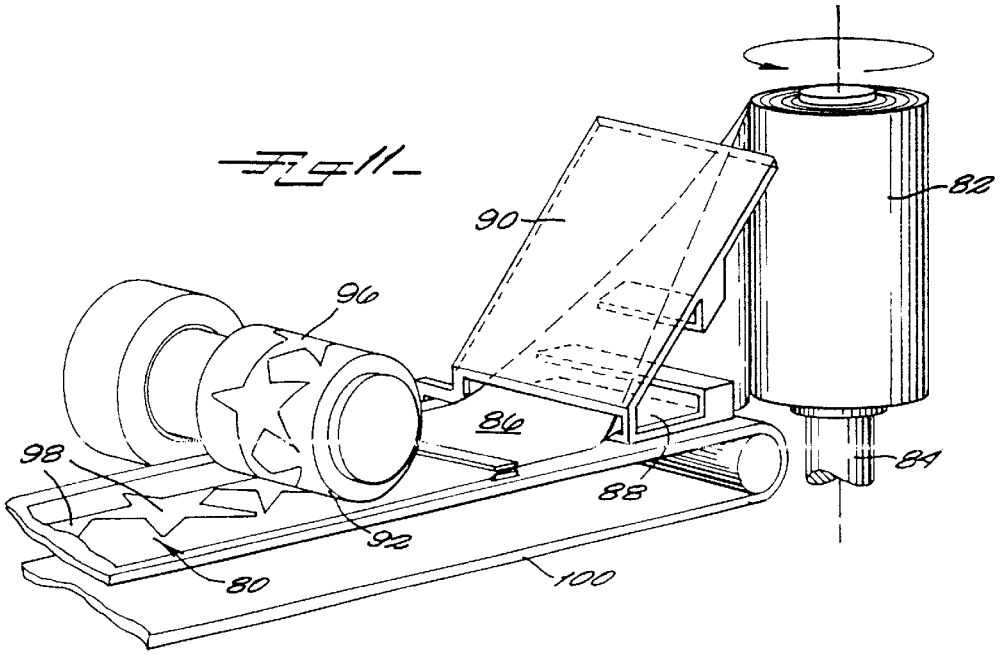
FIG. 11 is a perspective view of the manufacture of a balloon system according to a preferred embodiment of the present invention using a rotary die.

Referring now to FIG. 11, there is shown a method for making balloon system 80 according to a preferred embodiment of the present invention. The method of manufacture includes the step of unwinding a continuous roll of inflation-gas-impermeable film 82 from a spool 84 and folding film 82 to form an upper sheet 86 and a lower sheet 88. (Alternatively, multiple spools of suitable film may supply layers of film without the necessity of folding.) Preferably, film 82 is made of nylon or polyester film, but any resilient film that is generally impermeable to the inflating gas and strong enough to resist punctures could be satisfactory. The Ad is made by angled member 90, however, any suitable folding device may be used. A roller die 92 is then applied to the two layers of folded film 82 to define balloonlets 94 and to seal upper to lower sheet. Roller die 92 has several die cuts 96, shown as producing balloonlets 98 in the shape of stars in this example, as film 82 is conveyed by conveyor 100; however, it will be appreciated that die cuts 96 may come in any desired shape. Moreover, roller die 92 may be interchanged with another roller die having differently shaped die cuts about its circumference. In this way, balloon system 80 can be comprised of a variety of differently shaped balloonlets 98. Importantly, however, each balloonlet must be in fluid connection with the next balloonlet, either directly or through a stem or manifold, regardless of the shape of the next balloonlet.

Figure 12:
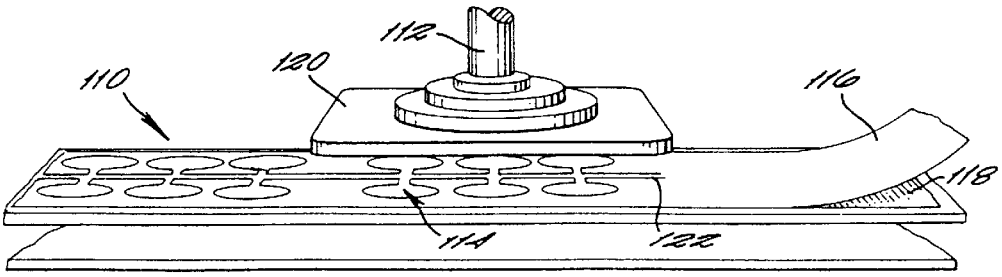
FIG. 12 is a perspective view of the manufacture of a balloon system according to an alternative preferred embodiment of the present invention using a flat die.

Referring now to FIG. 12, there is shown an alternative process for making balloon system 110 according to a preferred embodiment of the present invention. Balloon system 110 is made using a flat press 112 making a balloonlet cluster 114. In this process, film layers 116 and 118 are brought under a die 120 carried by flat press 112 wherein a cluster 114 including a portion of connecting stem 122 is formed with one application of die 120. Repeated applications of die 120 yield balloon system 110 limited only by the amount of film.

Sealing of upper and lower film layers 116, 118, respectively, is preferably achieved by heat sealing using heat directly applied by die 120 or with a laser; however, it is to be appreciated that crimping, chemical bonding by treating the film in the appropriate areas with a solvent or glue could also accomplish this task. Solvent or adhesives may be applied to upper or lower film layers 116, 118, respectively, or both, as desired. It is also recognized that, while this figure shows two layers of film, multiple layers of film could be used productively in this system. The balloon is then rimmed of excess film and may be decorated in accordance with known balloon manufacturing procedures such as printing or silk screening. Such decorations could be done before, after, or both before and after the processing described here.

Figure 13:
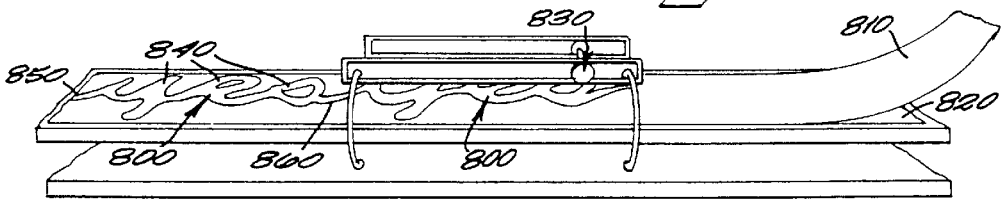
FIG. 13 is a perspective view of the manufacture of a balloon system according to an alternative preferred embodiment of the present invention using a plotter die.

Referring now to FIG. 13 there is shown an alternative process for making a balloon system 130 according to a preferred embodiment of the present invention. This illustration shows a laser plotter 132 making balloon system 130, which is in the form of the word "yes" as described in FIG. 7 repeatedly. In this process, film layers 134, 136, are brought under laser plotter 132 so that balloonlets 138 ("y"), 140 ("e"), and 142 ("s") are formed in sequence and then the sequence repeated as often as desired.

As defined above, "die" includes mechanical dies and laser plotters, which is a heat laser that is directed toward the layered balloon material and applies heat for a sufficient amount of time to melt the two layers together to form a gas-proof seal. Laser plotter 132 is computer controlled and seals film layers 134 and 136 together wherever it is directed by the computer (not shown). For complex balloonlets, complex series of different balloonlets, and to generate new "dies" quickly, a computer controlled laser plotter is preferred.

Sealing of film layers 134, 136, respectively, is preferably achieved as describe above, by heat sealing using a laser or with heat directly applied; however, it is to be appreciated that crimping, chemical bonding with a solvent and adhesion with a glue could also accomplish this task.

Balloon systems can be supported in a number of ways such as tension applied to the ends of the system, perhaps augmented by ties connected to the balloon system along its length. Helium, for example, is frequently used to float balloons and can be used to good effect in a balloon system according to the present invention. However, two functional features can be incorporated into each balloonlet's shape that will help to align the balloonlets with respect to each other. Both relate to the avoidance of effects that would otherwise occur to the balloonlets when inflated but that is not evident from the uninflated balloon. These are illustrated in FIGS. 14A and B and FIG. 15.

Figure 14A:
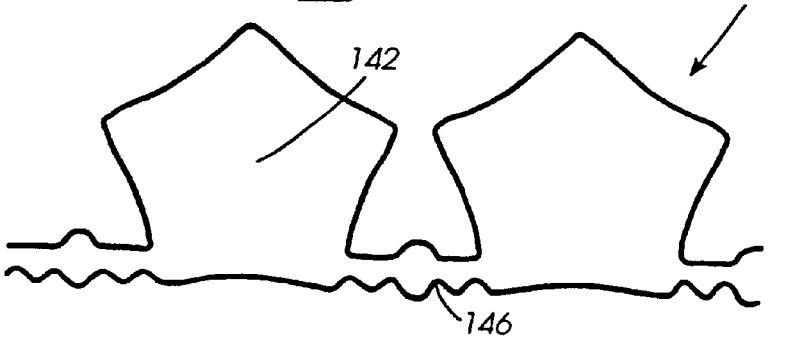
FIGS. 14A and 14 illustrate uninflated and inflated side views of a series of balloonlets that form an arched array of balloonlets made according to a preferred embodiment of the present invention.
Figure 14B:
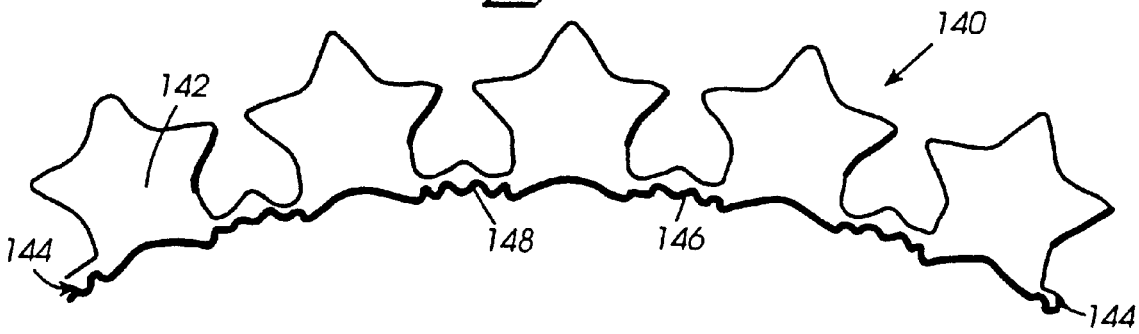

FIGS. 14A and B illustrate an uninflated and inflated balloon system 140 in the form of a row of star-shaped balloonlets 142 which are designed to form an arch when inflated with helium and when the ends 144 are tied down. FIG. 14A shows two adjacent balloonlets 142 as they would be produced by an appropriate die (not shown). Note that the star shape when inflated is best effected by an almost pentagonal shape in the uninflated balloonlet because, when the balloonlet puffs up as it fills with gas, the inwardly curving sides are pulled further inward. To force balloon system 140 to arch properly, notches 146 are formed in connectors 148. These inwardly curving notches 146 are drawn inwardly even more when the connectors 148 themselves puff up. Thus, connector 148 curves to orient adjacent balloonlets 142 in an arch. The depth and number of notches 146 determine in part the curve of the arch.

Figure 15:
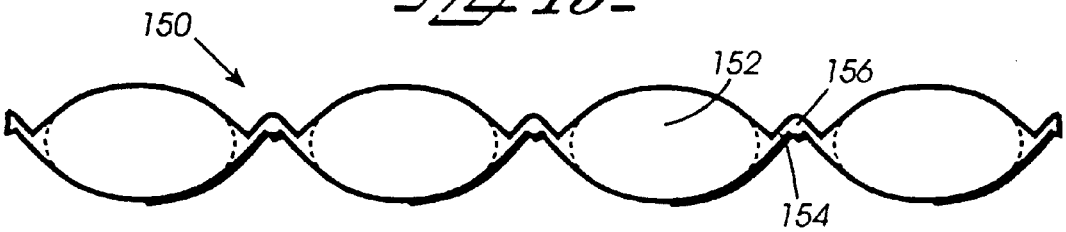
FIG. 15 illustrates a technique for maintaining the alignment of a row of balloon according to a preferred embodiment of the present invention.

The second feature that can be incorporated into each balloonlet that is functional and that helps with alignment is a small chamber in the connector, as illustrated in FIG. 15. There is a tendency of a string of balloonlets to "zigzag" with respect to each other and to lean with respect to each other. Balloon system 150 is illustrated as being made up of oval balloonlets 152 in this example. Included with each balloonlet 152 is a stem 154 that connects balloonlets and enables the fluid communication between them. By forming an expansion or chamber 156 in stem 154 that is larger than the stem, the leaning and zigzagging is neutralized because chamber 156 acts as a miniature balloonlet between each balloonlet 152. Thus, all balloonlets 152 zigzag and lean the same way and all chambers 156 zigzag and lean the opposing way but are virtually invisible because of their small size. The net effect is that all balloonlets 152 appear to be in alignment.

Tying and the use of helium are traditional ways s of supporting balloons. Other ways using grids as a support for tied balloons or into which balloons are stuffed are also known, as described in the Background of the Invention, above. However, the present invention includes a matrix made of an "expanded material" as the second major element of the present invention. In general, the expanded matrix is similar to expanded metal walkway grids; that is, overlapping slits are formed into a solid piece of material which is then pulled apart to form holes where there were only slits. Into these holes, balloons or balloonlets are squeezed.

In expanded metal grid walkways the fully expanded aperture is a six sided polygon, though two sides are frequently so small as to leave the impression of diamond shaped apertures. In this Detailed Description, "fully expanded aperture" refers to the aperture shape which is created by equal pressures exerted from the center of a cut against the sides of that cut while that cut is surrounded by apertures which share a side, and each of the surrounding apertures has equal pressure exerted from the center of that aperture against its sides. As the space between the ends of adjacent cuts is reduced the two sides affected are shortened. It is not possible to eliminate this space entirely in standard expanded metal grids because the cuts are in a direct line and when the space is 0 all the cuts in a line will touch and the sheet will be cut into strips.

A "virtual" touching of cuts can, however, be created that allows the effective space between cuts to go to 0 without cutting the sheet into strips. The rows of slits or bands of slits can be viewed as multilane highways rather than single lane paths. As the slits approach each other down the center lane, one or both of them can shift lanes away from the other. In this way they can meet as two cars might meet on the same highway without crashing. This virtual touching allows the creation of four sided apertures as well as the six sided ones which always occur in standard grids.

Figure 16:
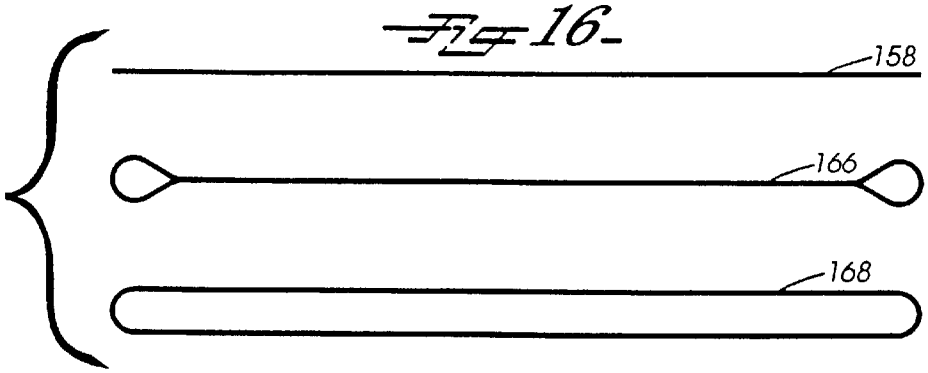
FIG. 16 illustrates the shapes of three slits usable with the present invention.

The choice of material for the matrix is important. It is preferably strong, light-weight, thin, somewhat resilient, white or clear but capable of taking on coloration, and inexpensive. These requirements are satisfied by several plastics. Although plastics can be selected to be puncture- and tear-resistant, they often tear easily after being punctured or torn. Therefore, in the preferred embodiment, as illustrated in FIG. 16, in addition to the usual slit 158, a slit 166 with rounded ends and an open slit 168 with rounded ends are preferred.

For example, FIGS. 17A–17D depict the top, perspective, side and end views of a sheet 160 of material suitable for making a matrix for holding balloons. Sheet has an array of slits 162 formed in it in a series of rows. Slits 162 of one row are staggered with respect to the slits of the adjacent rows, with a gap between any two adjacent slits 162 of one row being approximately midway along a slit 160 of the adjacent row so that the slits appear to be in a typical "brick" pattern.

When sheet 160 is expanded to open the slits as far as they go under a reasonable amount of pressure, a matrix of holes 164 is formed therein and the length of sheet 160 is shortened, as seen in FIGS. 18A–D, which parallel the views of FIGS. 17A–D. The length of any slit 162 is equal to one-half the perimeter of the hole 164 it forms when expanded. Diamond shapes as well as the hexagonal shape of the matrix illustrated in FIGS. 18A–D are typical of expanded metal grids.

In the present invention, additional design flexibility is obtained by varying the lengths, direction and arrangement of the slits, as will be described and illustrated. For example, in FIGS. 19A and B, the top and side views of a matrix 170 are illustrated where the slits 172 are all of the same length, and they naturally produce the same size holes 174. The gap 176 between any two slits is centered on and approximately one-third of the length of a slit 172. Thus, the resulting hole 174 is a regular hexagon.

When the size or placement of gaps is altered, the resulting matrix will be different. In FIGS. 19C and D, the size and placement of gaps 176 are altered to cause matrix 170 to curve to the left as indicated by a comparison of the direction of the arrows in FIG. 19B to FIG. 19D.

Figure 20A:
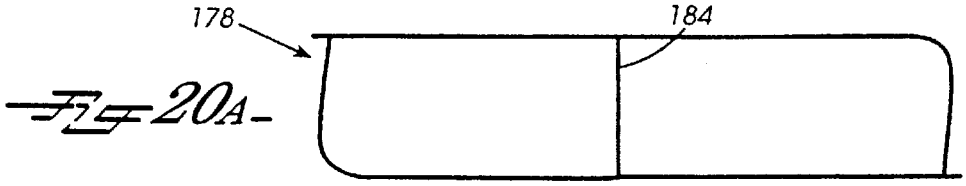
FIGS. 20A and 20B illustrate the side view of an expanded matrix section and the top view of the same matrix section before expansion where the matrix has simple overlapping slits.
Figure 20B:
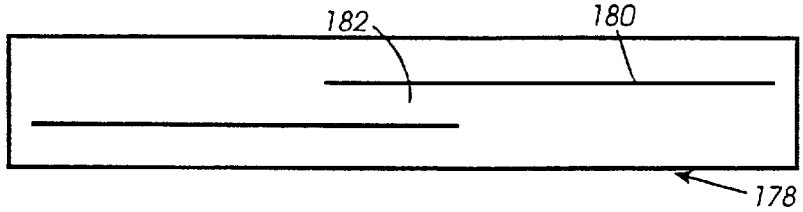

FIGS. 20A and 20B illustrate side and top views of a matrix 178 where slits 180 overlap in a simple way. The length of the section 182 of overlap of slits 180 is the height of mid-section 184 of FIG. 20A.

Figure 21A:
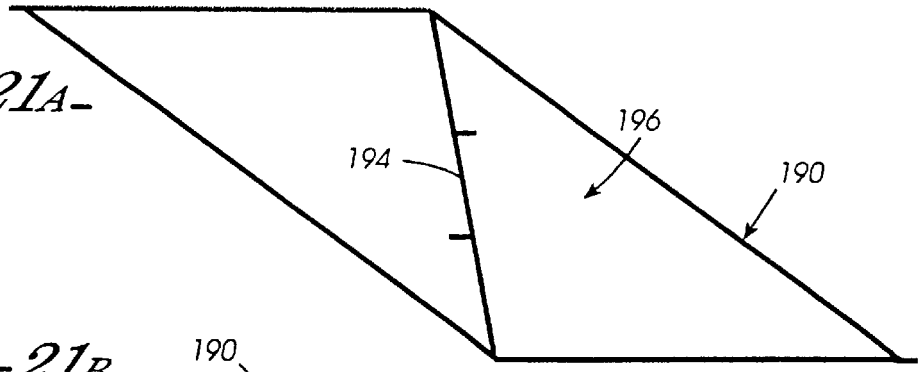
FIGS 21A and 21B illustrate the expanded side view and the unexpanded top views of a matrix with interlocking hook slits on their ends (FIGS. 21A and 21B, respectively)
Figure 21B:
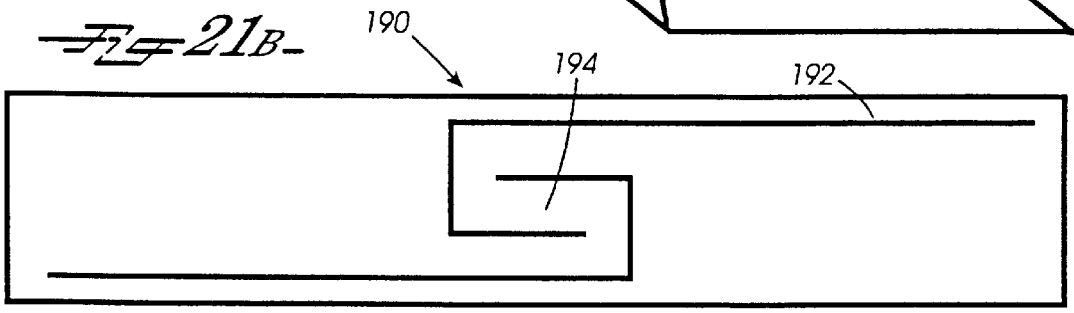

FIGS. 21A and 21B illustrate side and top views of the interlocking hook technique. Interlocking hook slits have at least two versions. The first is illustrated in the matrix 190 shown in FIGS. 21A and 21B. As the slits 192 are about to meet they are "moving" in opposing outside lanes. After passing each other, they then make "U" turns toward the center of the highway. Each crosses two lanes and heads back in the opposite direction in the third lane over. They pass each other again but each stops before his path actually cuts across the path of the other at what would be the bottom of the other's "V".

Passing slits 192 generate a common side 194 in their fully expanded apertures which is equal in length to the overlap between the slits 192. With the interlocking hook slit the common side is larger than with a simple overlap. The common side will be equal to their simple overlap plus twice the overlap 194 on their backward travel This means that sides of a fully expanded aperture 196 which utilize interlocking hook cuts can be greatly increased in length without the normally required increase in the width of the sheet of material from which it is cut.

This is true whether the interlocking cut occurs at the ends of two cuts as in this example or in the middle of two cuts as shown in FIG. 6A.

The use of overlapping forked slits is an especially powerful tool. It can generate common sides between slits in the same band or row of slits. It can be used to generate grid patterns including apertures with three, four, five, six, and more sides. Furthermore, it is a key element in generating many frameworks which expand naturally into three dimensional forms that range in complexity from sections of simple polyhedrons to geodesic domes.

Figure 22A:
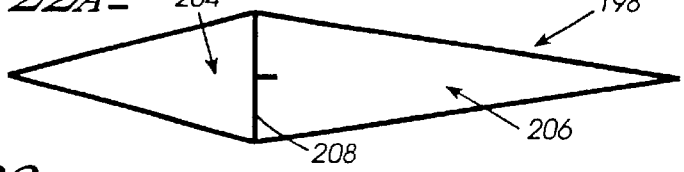
FIGS. 22A and 22B illustrate the expanded side view and unexpanded top views, respective, of a matrix with an evenly forked slit.
Figure 22B:
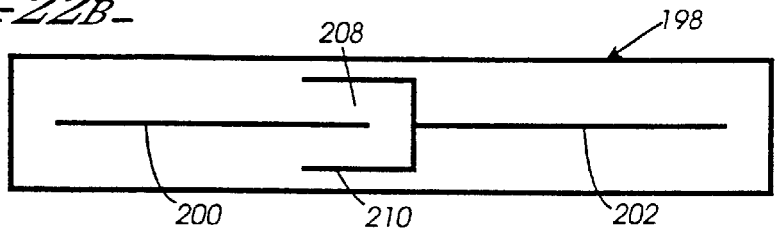

This slit configuration is generated when a single slit splits into two or more prongs on at least one end and those prongs overlap at least one end or prong of another slit. This technique is illustrated in FIGS. 22A and 22B and in FIGS. 23A and 23B. In the former figures, which illustrate the side and top views of a matrix 198, there is a regular slit 200 and forked slit 202. When expanded, two holes 204 and 206, respectively, are formed. Holes 204 and 206 have a common wall 208 formed by the overlap of the two prongs 210 of forked slit 202.

Figure 23A:
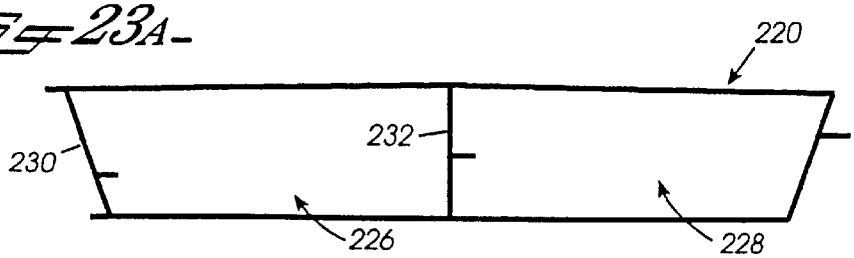
FIGS. 23A and 23B illustrate expanded side view and unexpanded top view, respectively of a matrix with unevenly forked slits.
Figure 23B:
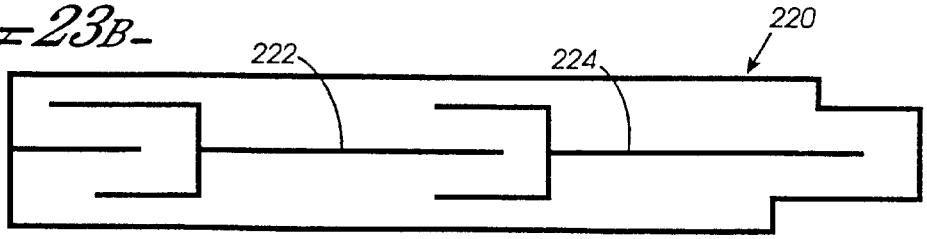
Figure 17A:
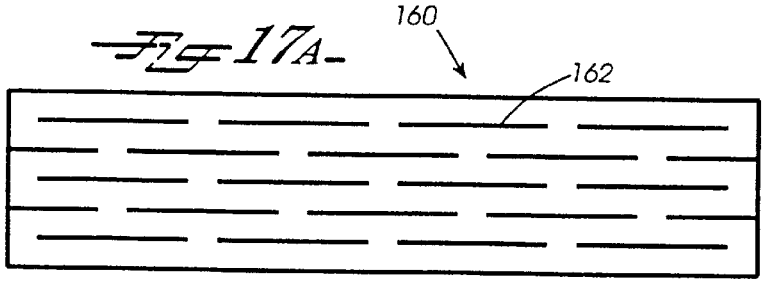
FIGS. 17A–D illustrate a standard matrix in top, perspective, side and end views, respectively.
Figure 17B:
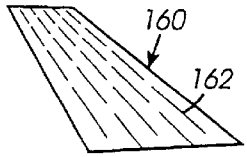
Figure 17C:
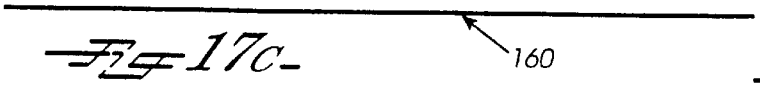
Figure 17D:
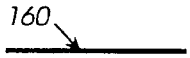
Figure 18A:
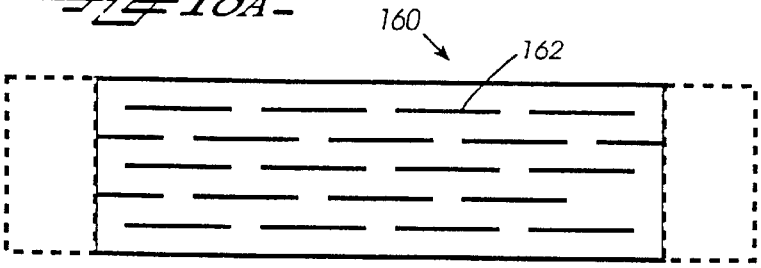
FIGS. 18A–D illustrate top, perspective, side and end views, respectively, of the standard matrix showy in FIGS. 15 expanded.
Figure 18B:
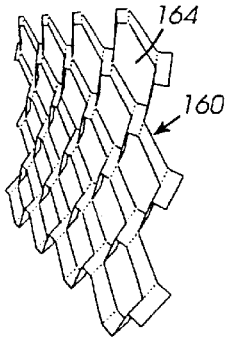
Figure 18C:
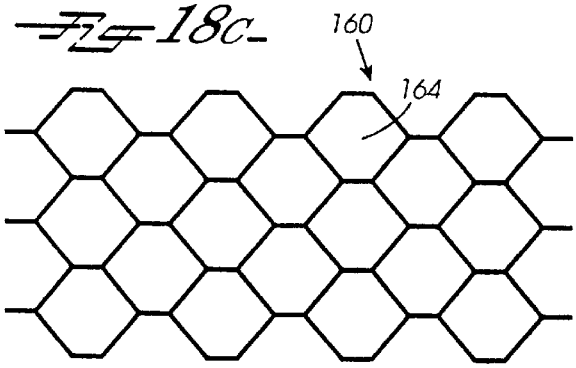
Figure 18D:
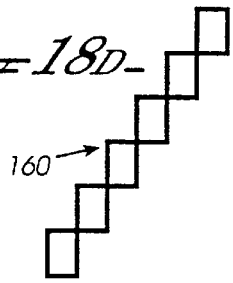

The prongs of the forked slit do not have to be equal in length. FIGS. 23A and 23B illustrate this in the side and top views, respectively, in a matrix 220 having two forked slits 222, 224, that form two holes 226, 228, respectively. Because slit 222 has one prong that is longer than the other, wall 230 is angled outward. Compare wall 230 to wall 232 formed by symmetric slit 224. Forked cuts also are shown in FIGS. 26A, 27A, 28A, 29A, 30A and 36A.

Another technique is the use of closely grouped linear cuts, parallel to and approximately the same length as the standard, primary cuts in a matrix. These multiple cuts fill the overall function normally taken by single cuts in a standard hexagonal matrix. Multiple cuts will produce multiple strips of material in the same aperture. These strips may be spread out around objects placed in the aperture like longitudinal lines around a globe and used to reduce the chances that a balloon or other object will fall out of the aperture.

Correspondingly, there is the use of linear slits which run parallel to the primary slit for most of their length, as illustrated in matrix 240 shown in FIGS. 24A and 24B. These secondary slits 242 extend to the ends of primary slit 244. When the aperture 246 is opened, these secondary slits 242 may be worked into a position as bands 248 around a balloon or other object in aperture 246 so as to suggest longitude lines around a globe.

FIGS. 25A and 25B illustrate a matrix 250 having one primary slit 252, two parallel secondary slits 254 and two tertiary slits 256 that begin just short of the middle of primary slit 252 and wrap around the end of primary slit and continue back to nearly the middle of the other side of primary slit 252. When this is done around both ends of primary slit 252, then two intermediate bands 258 and 260 form perpendicular "equators" around an entire globe-shaped aperture 262. These bands 258 and 260 of material can be used to reduce the chances that a balloon or other object will fall out of aperture 262.

Longitude and latitude slits may be used separately or together and malt be used in singles or multiples of each at a single primary cut.

Still another type of cut is designated "irregular secondary cut". Such cuts are also closely grouped linear cuts which run parallel to the primary cut for most of their length. These slits, however, are not limited to either running essentially the same length as the primary slit nor to wrapping around the end of a primary cut and extending equal distances on both sides of the primary slit. This irregularity in length or balance on the sides of primary slits means that when they are swung out around an object placed in their aperture they create neither longitudinal nor latitudinal lines. They wrap around the objects at various odd angles based on their length and the locations of their ends on the framework material. They are, however, useful for decoration and to help hold objects in place objects in the aperture formed.

While standard rectangular and circular sheets are clearly of use, many other shapes of material are valuable to finished products. For example, when fully expanded apertures in the shape of hexagons fill the matrix, then a fully expanded framework shape of a triangle or a hexagon or a six pointed star are simple and useful decorative shapes. These can be readily achieved by changing the outer size and shape of the cut in the sheet material in relation to the pattern of cuts.

Figure 31A:
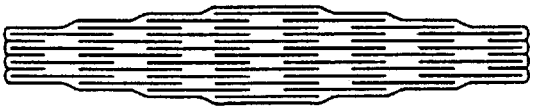
FIGS. 31A and 31B illustrate unexpanded top and expanded side views, respectively of a matrix in a hexagonal pattern.
Figure 31B:
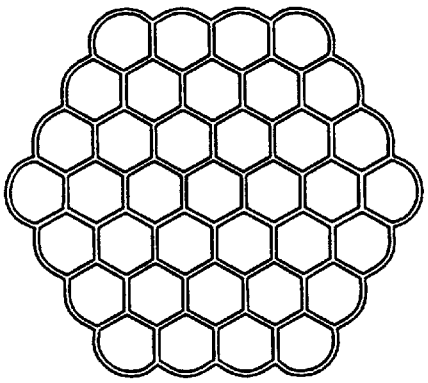
Figure 32A:
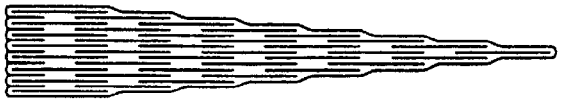
FIGS. 32A and 32B illustrate unexpanded top and expanded side views, respectively, of a matrix in triangular pattern.
Figure 30A:
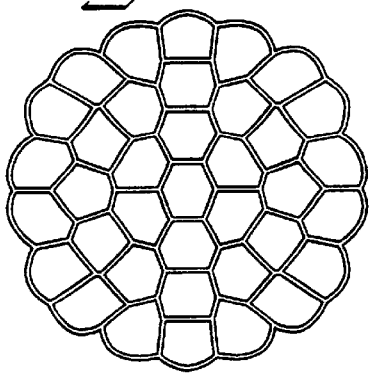
FIGS. 30A and 30B illustrate unexpanded top and expanded side views, respectively, of a matrix in a circular pattern.
Figure 32B:
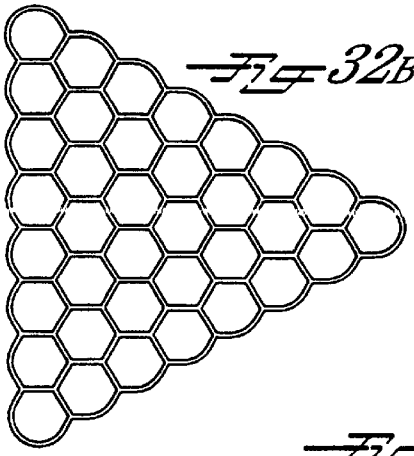
Figure 30B:
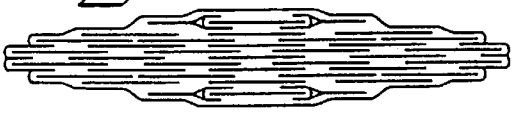
Figure 34A:
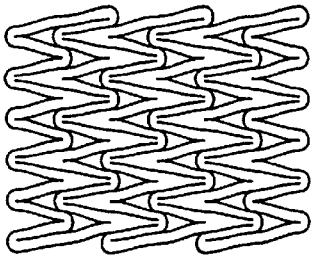
Figure 33A:
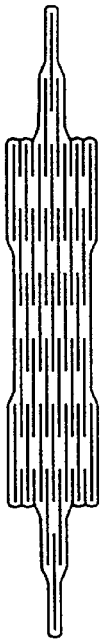
FIGS. 33A and 33B illustrate unexpanded top and expanded side views, respectively, of a matrix in,nix-pointed star pattern.
Figure 33B:
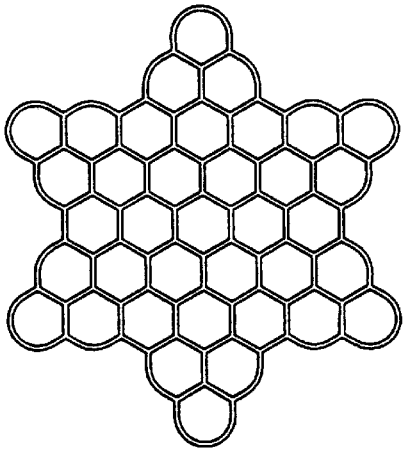
Figure 34B:
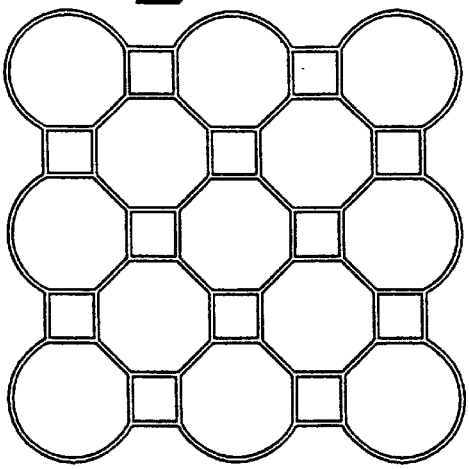

Variations in the spacing between the ends of cuts will change the configuration of apertures while retaining their expanded perimeters. Maintaining the length of the perimeter of apertures within a framework is useful when you want to insert objects with a consistent area such as balloons all of which are inflated to one size. Such variations can be used to change the over all shape of a fully expanded framework of a given number of apertures in a given number of rows of slits. For example, a pattern of cuts that would produce a generally hexagon shaped framework can be changed to produce a framework of a generally circular shaped framework by adjusting the spacing between the ends of the cuts. Note the difference in FIGS. 30A and 31A along with consequent differences in FIGS. 30B and 31B.

Circles and other framework shapes with relatively smooth curves are especially difficult to achieve with any regular, hexagonal grid pattern. Square, diamond, and hexagon grids always produce bumpy edges on some areas of large curves unless the relative scale of the apertures is quite small.

Figure 35A:
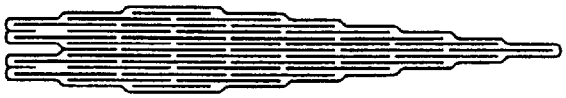
FIGS. 35A and 35B illustrate unexpanded top and side views, respectively, of an expanded matrix in a heart-shaped pattern.
Figure 29A:
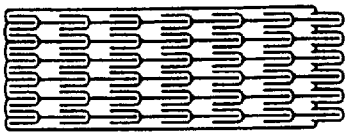
FIGS. 29A and 29B illustrate unexpanded top and expanded side views, respective of a matrix square pattern.
Figure 35B:
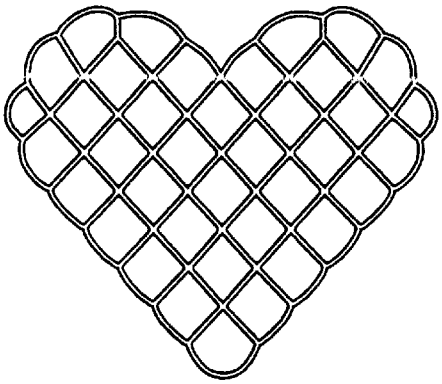
Figure 29B:
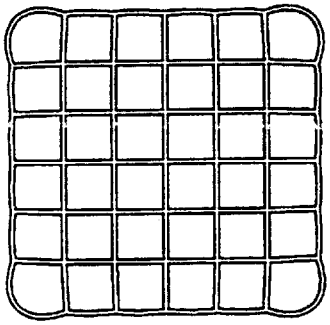

Altering the length of slits within a matrix is another way to change the configuration of a finished framework. This technique is illustrated below when two slits are shortened in a diamond pattern grid so as to help round off two corners in a heart design framework (See FIGS. 35A and 35B.).

Cuts do not have to be straight. Concentric cuts are shown in FIGS. 37A through 40B. FIG. 37A shows an expanded section view of the concentric overlapping cut matrix which is shown in an unexpanded top view in FIG. 37D. FIGS. 37B and 37C show expanded angular elevation views of columns of apertures created from the flat matrix in FIG. 37D. Standard concentric, overlapping cut matrix such as this include cuts of equal arc length 371 and spaces of equal arc length 372. Spaces between cuts in the same band of cuts are centered on the cuts in adjacent bands of cuts. Bands of cuts are concentric with equal distances between bands of cuts. Bands of cuts form complete circles. Cuts are longer than spaces between cuts. This standard always produces six sided polygons for apertures though spaces between cuts can be reduced to yield the appearance of diamond shaped apertures.

FIGS. 38A and 38B show angular elevations of two columns of apertures created by the expansion of the concentric matrix shown in an unexpanded top view in FIG. 38C. This matrix utilizes "virtual touching" of cuts in the same band of cuts to produce four sided polygons for apertures.

FIGS. 39A and 39B show angular elevations of two columns of apertures created by the expansion of the concentric matrix shown in an unexpanded top view in FIG. 39C. FIG. 39C shows that a "concentric" cut matrix need not be limited to circles. This matrix is an ellipse, but could very well be square triangular or any other shape as long as the bands of cuts looped around to connect with the starting point of the bands.

FIG. 40B shows an angular elevation of an expanded column of apertures of the concentric matrix shown in an unexpanded top view in FIG. 40A. This matrix uses overlapping cuts in the same band of cuts to create four sided apertures in independent rows of apertures. The shape, size, and number of apertures in bands of cuts may be changed independently of those in adjacent bands.

FIG. 41B shows an angular elevation of an expanded column of apertures of the curved matrix shown in an unexpanded top view in FIG. 41A. While this figures shows a simple curve to the rows of cuts, they might well have complex angles and curves. Such angles and curves in the top view of the nominally "parallel" cut matrix build in a tendency for the expanded sheet of matrix to have similar curves to the sheet. This can add structural stability and strength as well as decorative value.

FIG. 42A shows a top view of an unexpanded "tubular frame" matrix which is show in a first expanded view in FIG. 42B and in a fully expanded perspective view in FIG. 42B. The first expansion creates a series of six sided or four sided apertures (four sided shown here) depending on the stresses applied to the system. Walls 421 between apertures also have cuts in them. When these cuts in 421 are expanded and rotated 90 degrees they form a series of rings which can hold balloons, balloon systems or tubulars Many patterns of cuts can be used to create baskets, columns, arches and beams, domes, "dot matrix" graphics, "stained glass" windows, and various customized shapes. FIGS. 26A and 26B trough 36A and 36DB slow the unexpanded and expanded matrices for diamond pattern, cubic pattern, half soccer ball pattern, square pattern, circular pattern, hexagon pattern, triangle pattern, six-pointed star pattern, heart pattern, octagon/square and geodesic section pattern.

Each of these patterns, when expanded into an array of open holes can be filled with individual balloons of either the latex or plastic film variety. However, in the preferred embodiment, a balloon system is used, where each hole in the matrix is filled with a balloonlet. By using a balloon system, the potentially large number of balloons needed to fill the holes of a matrix are inflated more easily and deflated more easily than individual balloons. Furthermore, once the balloon system is oriented with respect to the matrix, all the balloons are near the specific holes they are to fill. Therefore, filling those holes is easier and quicker.

Some of the matrix patterns are essentially complete figures, such as the six-pointed star and the heart. Others, such as the square and the triangle, can be used as building blocks for larger constructions.

Not every hole in a matrix needs to be filled with a balloon. Indeed, none of the holes needs to be filed with a balloon. The matrix can make an interesting and useful display on its own. Any resilient, lightweight object can be used to fill the holes. For example, open or closed cell foam disks, balls or rods can be used instead of balloons, The objects inserted into the holes can be sprayed or presoaked in a solution that causes them to harden, such as a casting resin, after insertion to produce a light-weight construction. It is even possible to make matrix with much stronger materials and to fill apertures with more rigid objects as part of architectural and other larger scale and more permanent projects.

It will be apparent to those skilled in the art that many combinations, modifications and substitutions can be made to the preferred embodiments just described without departing from the spirit and scope of the invention as further defined in the appended claims.

What is claimed is:

1. A balloon display system, comprising:

a series of interconnected inflatable balloonlets with each balloonlet, includes at least one apex, each of said balloonlets being interconnected at an apex;

a flexible sheet including elongated slits extending through said sheet, said slits arranged in a plurality of rows with the slits of a given row being offset relative to the slits of each adjacent row;

wherein said sheet may be expanded to form a support matrix.

2. The balloon display system as defined in claim 1, wherein said support matrix is expanded to define a geometrical pattern selected from the group consisting of: a square pattern, a diamond pattern, a cubic pattern, a soccer ball pattern, a circular pattern, a hexagonal pattern, a six pointed star pattern, a heart pattern and an octagonal pattern.

3. The balloon display system as defined in claim 1, wherein said flexible sheet comprises at least two sheets sealed together and configured such that said matrix is inflatable.

4. The balloon display system as defined in claim 1, wherein said flexible sheet is formed from a plastic film.

5. The balloon display system as defined in claim 1, wherein said flexible sheet is formed from a metallic material.

6. The balloon display system as defined in claim 1, wherein said slits are linear.

7. The balloon display system as defined in claim 1, wherein said slits are "hook-shaped" or "fork-shaped".

8. The balloon display system as defined in claim 1, wherein fluid communication between at least two said balloonlets is terminated after said balloonlets are inflated.

9. The balloon display system as defined in claim 1, wherein said series of interconnected inflatable balloonlets is a series of interconnected inflatable chambers without fluid communication between said inflatable chambers.

10. The balloon display system as defined in claim 9, wherein each said inflatable chamber includes at least one apex, and each said inflatable chamber is interconnected to another said inflatable chamber at an apex.

* * * * *